US005752148A

United States Patent [19]

Yoneda et al.

[11] Patent Number: 5,752,148

[45] Date of Patent: May 12, 1998

[54] ELECTROMAGNETIC INDUCTION HEATING TYPE FIXING DEVICE AND METHOD

[75] Inventors: Satoru Yoneda, Toyohashi; Takeshi Kato, Toyokawa; Eiji Okabayashi, Toyokawa; Hiroaki Hinotani, Toyokawa; Tatsumi Fujishima, Toyokawa, all of Japan

[73] Assignee: Minolta Co., Ltd., Osaka, Japan

[21] Appl. No.: 556,203

[22] Filed: Nov. 9, 1995

[30] Foreign Application Priority Data

Nov. 10, 1994 [JP] Japan ..... 6-276685

[51] Int. Cl.[6] ..... G03G 15/20

[52] U.S. Cl. ..... 399/329; 219/619; 219/653

[58] Field of Search ..... 355/286; 219/216, 219/619, 469, 653; 399/122, 329

[56] References Cited

U.S. PATENT DOCUMENTS

| | | | |
|---|---|---|---|
| 3,213,256 | 10/1965 | Munnich | 219/619 |
| 4,243,869 | 1/1981 | Scribner | 219/216 |
| 4,348,102 | 9/1982 | Sessink | 399/329 X |
| 4,570,044 | 2/1986 | Kobayashi et al. | 219/619 |
| 4,585,325 | 4/1986 | Euler | 355/290 |
| 4,912,514 | 3/1990 | Mizutani | 355/272 |
| 5,053,829 | 10/1991 | Field et al. | 355/290 |
| 5,428,435 | 6/1995 | Yasuda et al. | 355/295 |
| 5,436,104 | 7/1995 | Yasuda et al. | 430/124 |

FOREIGN PATENT DOCUMENTS

| | | |
|---|---|---|
| 1-144084 | of 1989 | Japan . |
| 2-162383 | of 1990 | Japan . |
| 5-11651 | of 1993 | Japan . |

*Primary Examiner*—Arthur T. Grimley
*Assistant Examiner*—Quana Grainger
*Attorney, Agent, or Firm*—Sidley & Austin

[57] ABSTRACT

A toner image formed on a recording member is fixed onto the recording member by a fixing device having a heatable member, a heater for heating the heatable member positioned on one side of the heatable member, the recording member being positioned on an opposite side of the heatable member and spaced from the heatable member to heat the recording member by radiation from the heatable member, and a fixing structure for fixing the toner image on the heated recording member. The heatable member can be a fixing belt arranged in a loop while the heater is an electromagnetic induction coil positioned substantially within the loop. The electromagnetic induction coil generates a magnetic flux perpendicular to the transport direction of the fixing belt to produce an eddy-like induction current in a conductive member of the fixing belt to heat the fixing belt. The fixing belt, in turn, heats the recording member on the exterior side of the belt to soften the toner image thereon. The fixing structure, e.g., a pressure roller, then fixes the toner image on the heated recording member. The heatable member may be a conductive guide member, or a belt arranged in a loop and having a tension roller with the electromagnetic induction coil being arranged on an interior side of the tension roller.

27 Claims, 9 Drawing Sheets

ELECTROMAGNETIC INDUCTION HEATING TYPE FIXING DEVICE AND METHOD

BACKGROUND OF THE INVENTION

1. Field of the Invention

The present invention relates to a method of and apparatus for fixing toner images generated in electrophotographic printers, copying machines, and the like.

2. Description of the Related Art

Electrophotographic printers, copying machines and the like are generally provided with devices for fixing a toner image which has been transferred to a recording medium such as a paper sheet, transfer sheet or the like. Such fixing devices are generally provided with a fixing roller for thermally fusing toner on a recording sheet, and a pressure roller for gripping the sheet by making pressure contact with the fixing roller. A heating member is maintained on the shaft of the fixing roller, the heating member including, for example, a halogen lamp or the like, for generating heat when a predetermined pressure is applied to the fixing roller.

However, in conventional fixing devices provided with heating elements such as the aforesaid halogen lamp or the like, a relatively long standby time is required after the power source is turned on before the fixing roller attains a predetermined temperature suitable for fixing. On the other hand, when the heating capacity of the fixing roller is increased so as to shorten the standby time in an attempt to improve user operation characteristics, a disadvantage arises in increased power consumption and a correlated reduction in energy conservation.

Therefore, it is desirable to lower energy consumption of the fixing device, yet improve user operation characteristics (for example, increasing printing speed), thereby improving the value of products such as copying machines and the like. To achieve such improvements, not only must toner fixing temperatures and fixing roller heating capacities be reduced, but electric-to-heat conversion efficiencies must also be improved.

Various electromagnetic induction heating type fixing devices have been proposed to achieve such improvements. For example, Japanese Unexamined Patent Application No. HEI 1-144084 discloses a fixing device provided with a fixing belt comprising a conductive member which moves while in contact with a recording medium, and an induction heating coil arranged on the exterior side of and opposite to the fixing belt. A high frequency current flows to the coil and produces a high frequency magnetic field which generates an induction eddy current in the fixing belt, thereby producing Joule heating in the fixing belt itself. Thus, the temperature rise time of the aforesaid fixing device can be reduced by using the aforesaid method of induction heating of the fixing belt which has a small heat capacity.

However, because the induction heating device is provided on the exterior side of the fixing belt, the size of the fixing device is necessarily enlarged, and the proportion of the interior volume of the copying machine or the like occupied by the fixing device is also increased thereby, with a resultant adverse impact on the compactness of the overall apparatus which is increasingly demanded by equipment owners and operators. Furthermore, the induction heating apparatus generates a high frequency magnetic field and associated electromagnetic noise which may adversely affect various other components contained within the copying machine. Therefore, it is necessary to separately provide an electromagnetic noise shield which undesirably increases the cost of the equipment and further undesirably increases the size of the fixing device.

Methods other than electromagnetic induction heating methods for reducing operating standby time are also known for use in copying machines and the like. One such alternate method is disclosed in Japanese Unexamined Patent Application No. HEI 2-162383. This method provides a process for thermally softening the toner on a recording sheet via a fixing film, a process for cooling and solidifying the adhered fixing film and recording sheet, and a process for separating the fixing film from the recording sheet. This method is known to provide excellent color toner mixing and allows the cooling of the toner image in a softened and fused state without producing a so-called offset phenomenon, and further allows a broad selection of usable recording sheet types as well as a wide temperature operating range of the heating element (such as a heating roller and the like).

However, this method also presents certain disadvantages insofar as the recording sheet stretches and contracts, thereby causing sliding between the recording sheet and fixing film as well as partial separation of the recording sheet and fixing film because the fixing film and recording sheet are transported in a state of contact while being heated, thereby disturbing the toner image. Furthermore, undesirable heat loss occurs between the heating element and recording sheet because the recording sheet is heated by the heating element such as a heating roller through a fixing film, resulting in low heat transfer efficiency.

SUMMARY OF THE INVENTION

It is an object of the present invention to provide a method and apparatus for a fixing device which reduces standby time required to reach a suitable fixing temperature.

It is another object of the present invention to provide a method and fixing device which conserves energy by operating at a reduced toner fixing temperature.

It is a further an object of the present invention to provide a fixing device having compact dimensions in the installed condition and which has minimal operating heat loss.

A fixing device for fixing a toner image formed on a recording member onto the recording member according to the present invention includes a heatable member, a heating means for heating the heatable member and positioned on one side of the heatable member, wherein the recording member is positioned on an opposite side of the heatable member and spaced from the heatable member to heat the recording member by radiation from the heatable member, and fixing means for fixing the toner image on the heated recording member.

The heatable member according to one embodiment of the invention includes a fixing belt having a conductive element and formed into a loop, and the heating means comprises an electromagnetic induction coil positioned within the loop for generating an induction eddy current in the conductive element to heat the fixing belt to, in turn, heat the recording member.

The fixing means includes a pressure member for impressing the recording member against the fixing belt to fix the toner image onto the recording member after the recording member has been heated.

With the electromagnetic induction coil provided on the interior side of the fixing belt, it generates a magnetic flux perpendicular to the transport direction of the fixing belt by means of a high frequency current flowing to the coil. As a result, an eddy-like induction current is generated in the conductive element of the fixing belt, and the fixing belt is heated by natural resistance. A recording member bearing a transferred toner image is heated without contact by the heated fixing belt, and after the toner at this part of the recording member is softened to a certain extent, the recording member is transported into a nip formed between the fixing belt and the pressure member. The toner image transferred onto the recording member is fixed to the recording member by the heat and the pressure applied at the nip.

The electromagnetic induction coil for generating an induction eddy current to heat the fixing belt effectively utilizes the interior space bounded by the interior side of the fixing belt, resulting in a more compact device. Moreover, electromagnetic noise generated by the electromagnetic induction coil is mostly shielded by the fixing belt, such that a relatively smaller shield member is required to further minimize such noise, and further increasing the compactness of the fixing device.

The fixing device according to an alternative embodiment includes a conductive guide member as the heatable member for guiding the recording member, and the heating means comprises an electromagnetic induction coil which generates an induction eddy current in the guide member. A pair of rollers provided adjacent to the guide member on the downstream side thereof grip and transport the recording member, the electromagnetic induction coil being mounted opposite the transported recording member.

The induction current is generated in the guide member by means of a high frequency current flowing to the electromagnetic induction coil so as to heat the guide member. The recording member bearing a transferred toner image is heated without contact by the heated guide member such that the toner is softened to a certain extent. Then, the recording member is transported into the nip formed between a pair of rollers, and the toner image is fixed to the recording member by means of the heat accumulated on the toner and recording member and the pressure applied at the nip. The fixing device according to this embodiment is extremely inexpensive and reduces the overall cost of the apparatus.

The fixing device according to another alternative embodiment includes a tension roller, having a thermal conductivity and a specific inductive capacity, which exerts a tension force on a fixing belt, and an electromagnetic induction coil arranged on the inner side of the tension roller.

Virtually all of the magnetic flux generated by the electromagnetic induction coil passes through the tension roller to reach the fixing belt. The heat produced in the fixing belt is partially retained in the fixing belt and partially transmitted through contact with the tension roller. Since the fixing belt is extremely thin, heat migration in the widthwise direction of the fixing belt is slight, and the contact transference of heat from the fixing belt migrates in the axial direction of the tension roller, thereby achieving uniform temperature distribution in the widthwise direction of the fixing belt. The recording member bearing a transferred toner image is heated without contact by the fixing belt, then the toner is completely fused onto the recording member via heat and pressure at the nip formed between a pressure member and the drive roller upon which the fixing belt is looped. Thus, the temperature is uniformly distributed in the widthwise direction of the fixing belt so as to realize excellent fusion of the toner on the recording member.

Additional features and advantages of the present invention will be apparent from the ensuing description and claims read in conjunction with the attached drawings.

DETAILED DESCRIPTION OF PRESENTLY PREFERRED EMBODIMENTS

Preferred embodiments of the present invention are described hereinafter with reference to the accompanying drawings.

Figure 1:
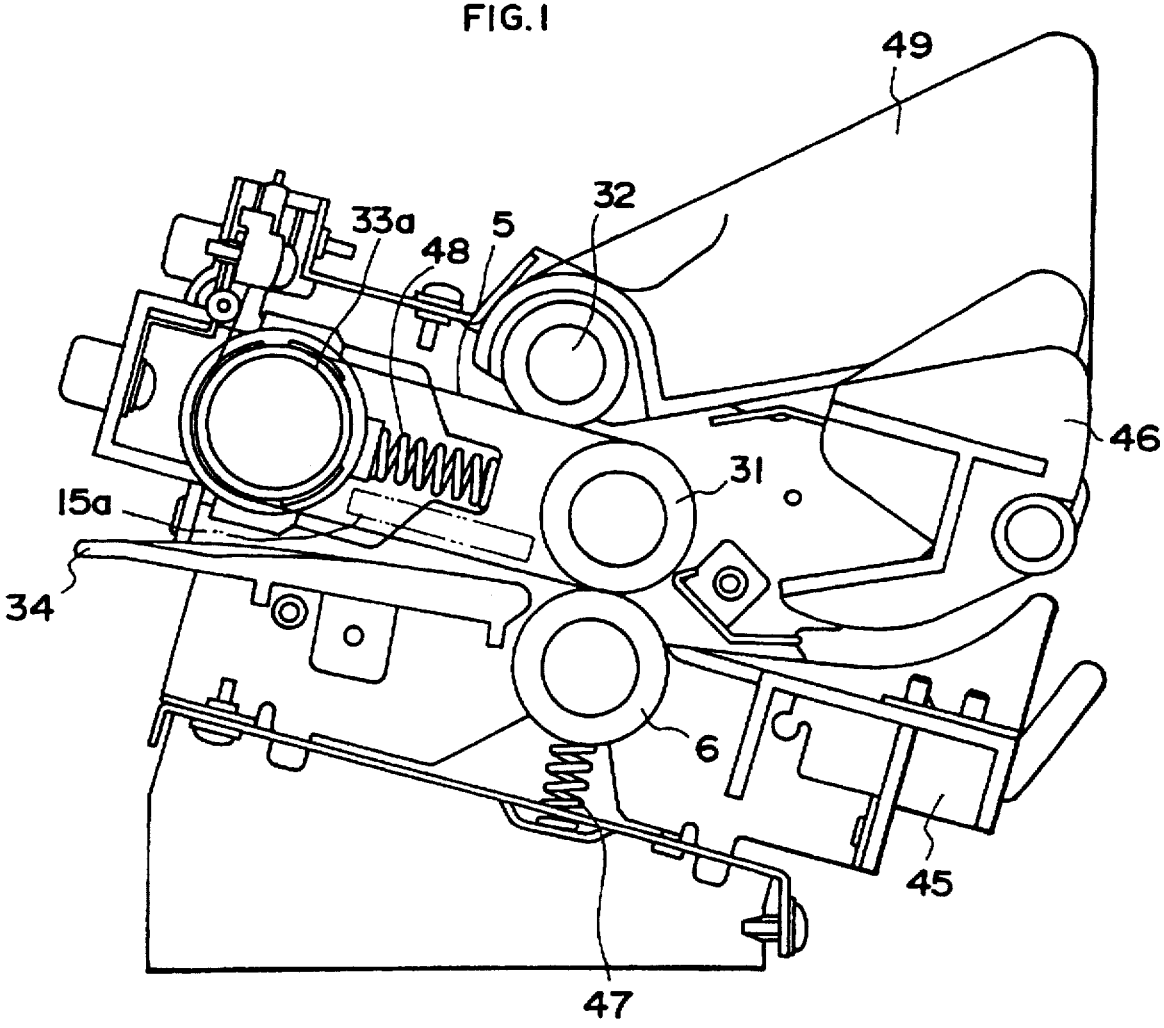
FIG. 1 is a side elevation view of an electromagnetic induction heating type fixing device according to a first embodiment of the present invention.

FIG. 1 is a side elevation view of an electromagnetic induction heating type fixing device according to a first embodiment of the present invention. The fixing device is generally designated by reference numeral 100 and is adapted to be incorporated in a copying machine, printer or the like (hereinafter referred to as the "apparatus"). Fixing device 100 includes a fixing belt 5 formed of a conductive member. An electromagnetic induction coil for generating an induction eddy current to heat the fixing belt 5 includes a coil assembly 15*a* (more fully described below) on an interior side of the fixing belt 5.

Fixing belt 5 is wrapped around a drive roller 31 and a tension roller 33*a* at a predetermined tension exerted by compression coil spring 48. The drive roller 31 receives a drive force from the apparatus so as to be rotated in a counterclockwise direction. The fixing belt 5 is propelled by the rotation of drive roller 31, and a pressure roller 6 arranged adjacent to the drive roller 31 is also driven as a pressure applying member. The pressure roller 6 applies pressure in the axial direction of drive roller 31 via a compression coil spring 47, so as to form a nip at a tangent to the two rollers 6, 31.

An oil application roller 32 is provided with an exterior surface which makes contact with the fixing belt 5. The oil application roller 32 is secured by holder 49, and is detachable from the fixing device.

A recording sheet P is introduced to and guided along a prefixing guide 34 in the direction indicated by arrow H in FIG. 1. The sheet P is inserted into the nip formed between the fixing belt 5 and the rollers 6, 31, to fix the toner image by heat and pressure. The recording sheet P is ejected from the nip and is then guided by guides 45 and 46 for discharge.

Figure 2:
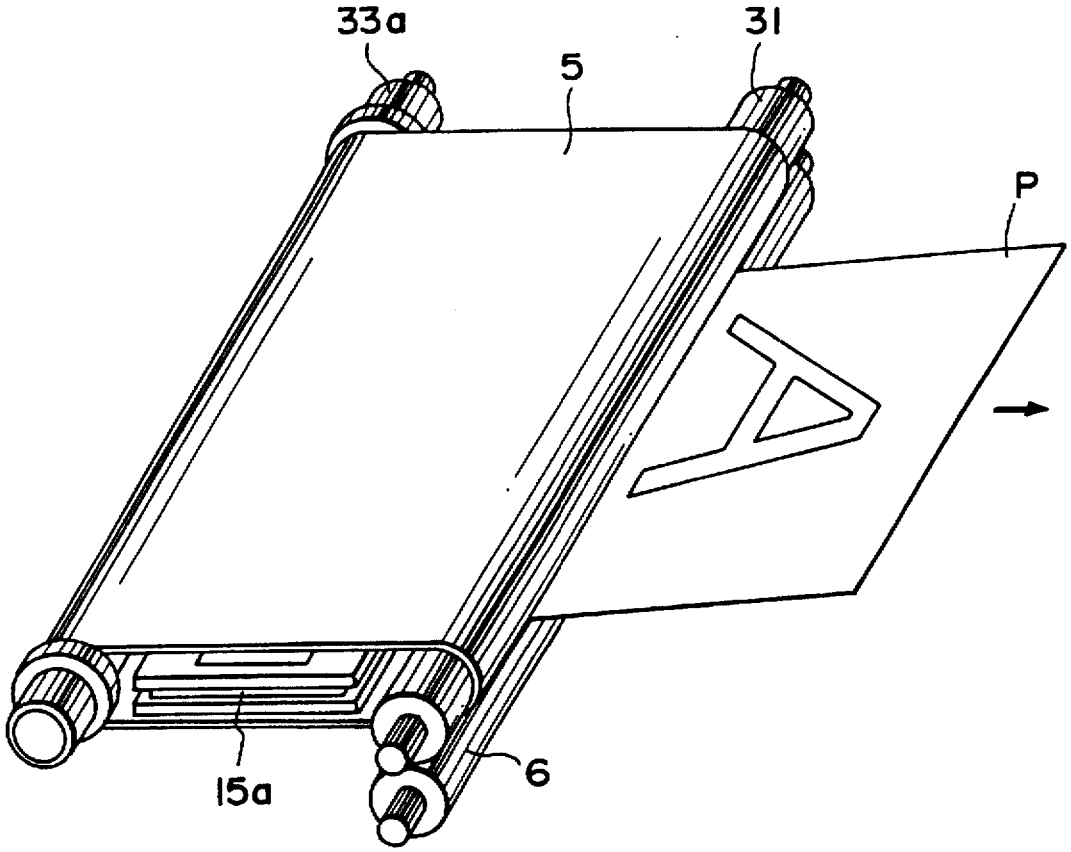
FIG. 2 is a perspective view of the main portion of the fixing device of FIG. 1.

With reference now to FIG. 2, fixing belt 5 is formed of a conductive member provided with a surface having a heat-release resistant-type layer or heat-resistant rubber layer provided with carbon steel, stainless steel alloy, nickel or the like. The fixing belt 5 accommodates a coil assembly 15*a* provided in a space bounded by the interior side of the fixing belt. Thus, space is effectively utilized by placing the coil assembly 15*a* in the heretofore unused inner space bounded by the fixing belt, thereby achieving a compact fixing device. In this condition, the fixing belt 5 also functions as an electromagnetic shield around the coil assembly 15*a*.

The coil assembly 15*a* is positioned in confronting relationship with the interior surface of fixing belt 5, so as to be separated therefrom by a uniform distance. The coil assembly 15*a* may alternatively be constructed so as to make contact through an insulation member (not shown). The coil assembly 15*a* may be fixedly attached to the structure of the fixing device or to the side of the apparatus (also not shown). The fixing belt 5 is driven by the drive roller 31 which receives a drive force from the apparatus via a geared drive system (not shown). Pressure roller 6 applies pressure on the exterior surface of the fixing belt 5 in the axial direction of drive roller 31, and the pressure roller 6 is rotated in conjunction with the movement of fixing belt 5 and then ejects the recording sheet P in the direction indicated by arrow J.

Figure 3:
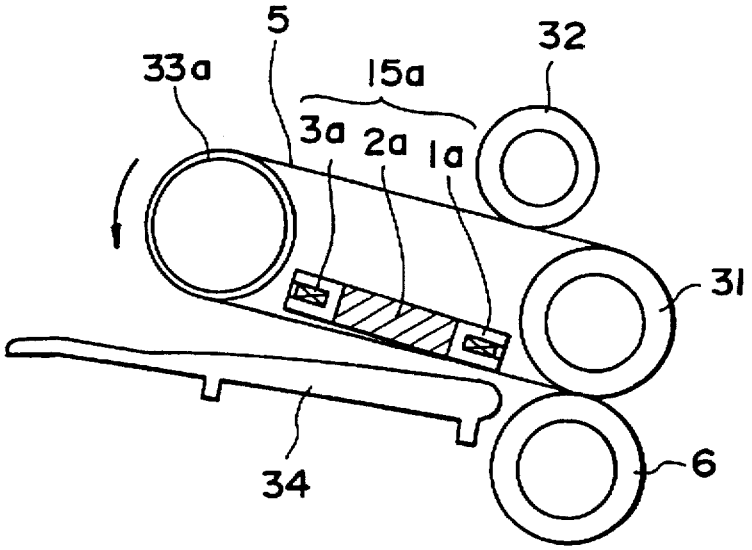
FIG. 3 is a side elevation view, partly in cross-section, of the main portion of the fixing device of FIG. 1.

FIG. 3 shows the main parts of the fixing device of FIG. 1. The coil assembly 15*a*, which is received in a space bounded by the interior side of the fixing belt 5, comprises a core 2*a* held by a bobbin 1*a*, and a coil 3*a*; and is mounted at a position opposite the recording sheet P transported via the fixing belt 5. An induction current is generated in the fixing belt 5 by a high frequency current flowing through coil 3*a*, so as to heat the fixing belt 5. Thus, the heating region can be set to correspond with and extend in the transport direction of the recording sheet P, thereby enabling a lower fixing temperature to be set. There is little heat loss because the apparatus and method of the present invention provides that the portion of the fixing belt 5 confronting the recording sheet P is directly heated, and the time required for the heating portion to attain a suitable fixing temperature is reduced due to the low heat capacity of the heating portion.

The recording sheet P bearing a transferred toner image is transported over the prefixing guide 34 from the left side of the apparatus shown in FIG. 3, and is heated indirectly, i.e., via noncontact radiation heating, by the heated fixing belt 5. Accordingly, image noise is not produced in the aforesaid process because it is a noncontact process. After the toner is softened to a certain extent at this region, the recording sheet P is transported by the fixing belt 5 into the nip formed between the fixing roller 31 and the pressure roller 6. The toner image transferred onto the recording sheet P is suitably softened and fixed to the recording sheet P by means of the heat and the pressure applied thereto at the nip.

According to all of the disclosed embodiments, heating is achieved by the fixing belt 5 which is heated before fixing and without contact, and the heat maintained on the recording sheet P and the fixing belt 5 is utilized at the nip to reliably fix the toner image by the heat and pressure imparted by pressure roller 6. Thus, the set temperature of the heating portion can be reduced and the system speed increased without changing the set temperature.

The hardness of drive roller 31 is set to be higher than the hardness of pressure roller 6. The sectional configuration of the nip formed between the fixing belt 5 and the pressure roller 6 is therefore convex toward the toner image transferred onto the recording sheet due to the relative roller hardnesses.

The quantity of heat accumulating on the fixing belt 5 is virtually completely conducted into and absorbed by the recording sheet at the nip. Thus, the region achieving high temperature in the fixing device is from a position adjacent to the coil 3*a* to the nip, and the disadvantage of conventional belt methods which necessarily require power consumption increases as the belt length increases due to the increased heat-dissipating surface area is eliminated. Furthermore, the construction of the present invention requires that only the region of the fixing belt 5 upstream from the nip is heated, thereby further reducing power consumption requirements.

The portion of the fixing belt 5 that is downstream of the nip is coated with a toner releasing oil which is applied by the oil application roller 32 until it moves to the reheating area. The oil application roller 32 is supported by the holder 49 (FIG. 1), and is rotated by the movement of the fixing belt 5. The surface of oil application roller 32 comprises a felt-like material which effectively removes toner adhered to the surface of the fixing belt 5 via the rotation operation. Holder 49 is constructed to allow the apparatus operator to remove the holder 49 and the oil application roller 32 as a unit.

Figure 4C:
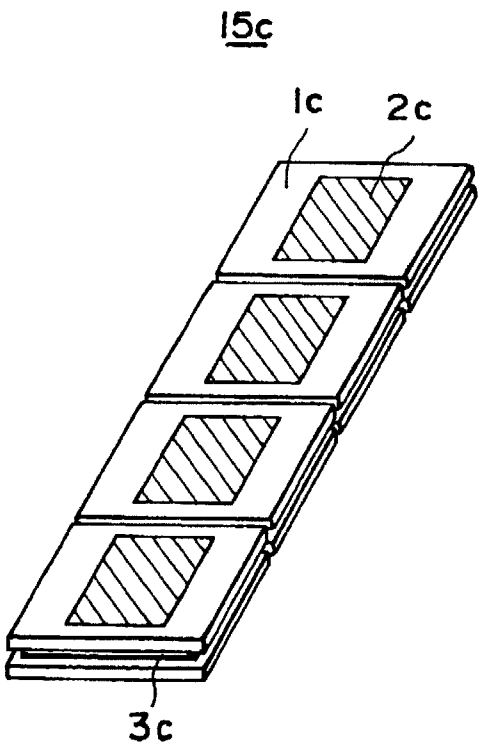
FIGS. 4(A)–4(C) are perspective views of three embodiments of a coil assembly for use with any of the fixing device embodiments of the present invention.
Figure 4B:
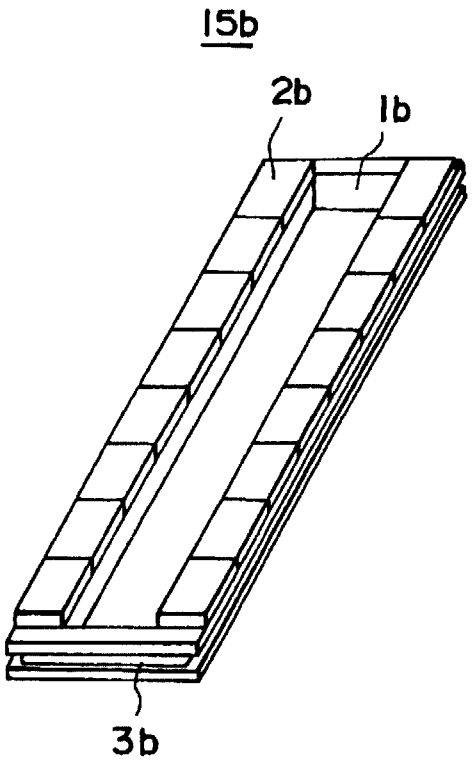
Figure 4A:
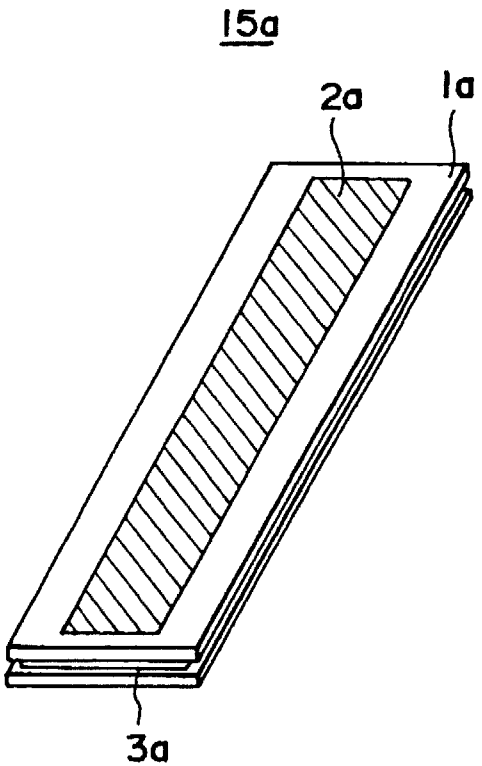

FIGS. 4(A)–4(C) are perspective views showing three embodiments of a coil assembly of the present invention. As shown in FIG. 4(A), a coil assembly 15*a* includes a bobbin 1*a* formed of, for example, a heat-resistant plastic. The center of the bobbin 1*a* is provided with a centered rectangular slot. A core 2*a* formed of, for example, a ferrite core or laminate core, is inserted into the center slot of bobbin 1*a*. A coil 3*a* for generating an induction current around the bobbin 1*a* is provided with a plurality of unidirectional windings (not shown). The coil 3*a* may be comprised of, for example, copper wire having a fusion layer and an insulation layer on the surface thereof.

Various other coil assembly constructions may be used. For example, a coil assembly 15*b* comprising a core 2*b* is arranged on the exterior side of bobbin 1*b* and positioned opposite coil 3*b*, as shown in FIG. 4(B). An additional embodiment of a coil assembly is shown in FIG. 4(C), which shows a coil assembly 15*c* comprising a bobbin 1*c*, core 2*c*, and coil 3*c* equally divided in the lengthwise direction corresponding to the direction of travel of the recording sheet. If the coil assembly 15*c* is used, energy can be conserved because an individual area or areas of the coil assembly may be selectively energized by the high frequency current, such that only the selected region or regions, at a position necessary to heat a small size recording sheet, is heated during the fixing process.

Figure 5:
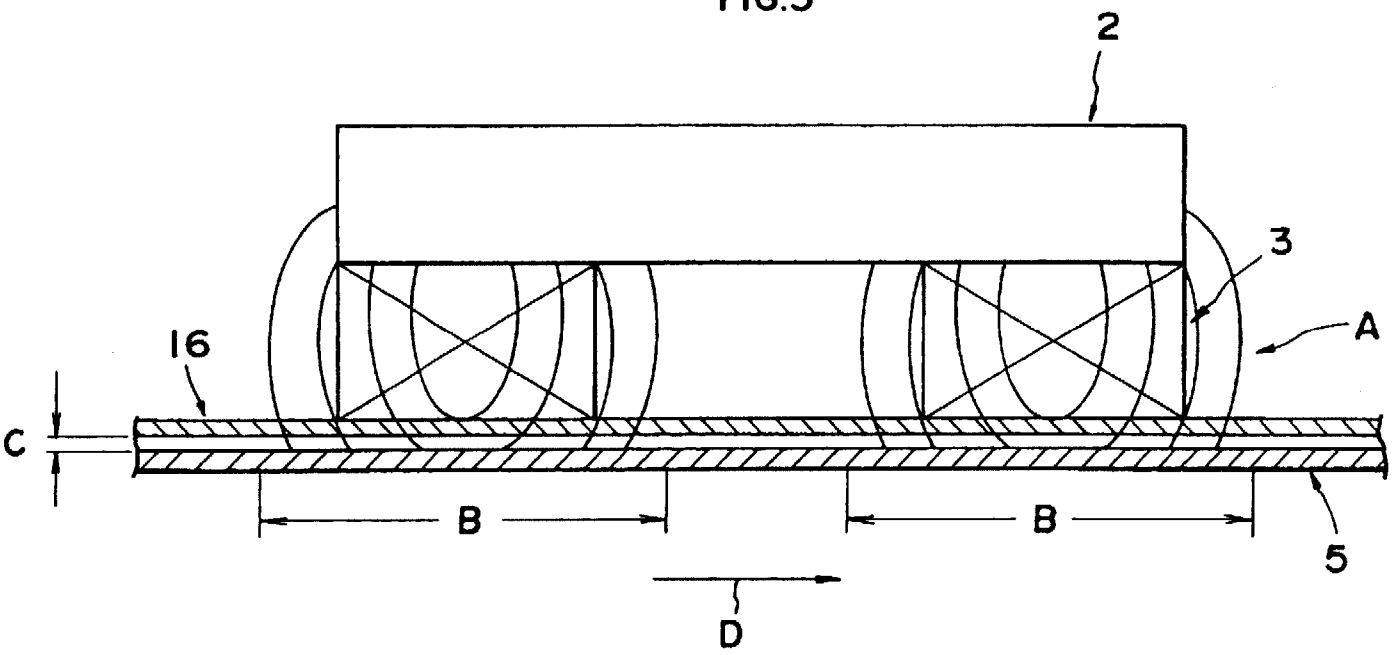
FIG. 5 is a schematic representation of the principle of the electromagnetic induction heating type fixing device as applied to the present invention.

Referring now to FIG. 5, when a high frequency current (for example, in the range of several kHz to several tens of kHz, although a current outside this range is contemplated) is applied to any selected coil 3, a perpendicular magnetic flux A is generated in the direction indicted by movement D of the fixing belt 5 according to Ampere's right-hand turn rule. Magnetic flux A generates an eddy-like induction current so as to produce a magnetic flux in the opposite direction to magnetic flux A in fixing belt 5 according to Lensl law. This induction current is converted into Joule heat by the natural resistance of the material of construction selected for the fixing belt 5 so as to heat the fixing belt 5. In the construction shown in FIG. 5, a significant magnetic flux field is formed in the regions B bounded by the fixing belt 5 adjacent to the side surface of coil 3 and the core 2, and heating is achieved locally with a relatively flat or even distribution therebetween. The heated region corresponds to the position opposite the prefixing guide 34 of fixing belt 5 as shown in FIG. 3. Referring again to FIG. 5, reference number "16" refers to an insulation member, and a gap C is formed between the coil 3 and the fixing belt 5.

The current generated by electromagnetic induction according to the present invention has a distribution in the member thickness direction corresponding to the material of the member, and the magnetic flux depth of penetration $\delta$ is proportional to the reciprocal of $(k\mu f)^{1/2}$, where k is the conductivity, $\mu$ is the magnetic permeability, and f is the frequency. That is, the induction current accumulates on the surface in accordance with the frequency. Accordingly, a minimum limit of heat can be used if the thickness of the heating area is set at a value approaching the depth of penetration of the magnetic flux, thereby accelerating the speed of temperature rise, and reducing operator standby time. Thus, the member used to generate the induction eddy current will be selected to have a suitable thickness in accordance with the material used and frequency insofar as heating efficiency and speed of temperature rise are satisfied.

Figure 6:
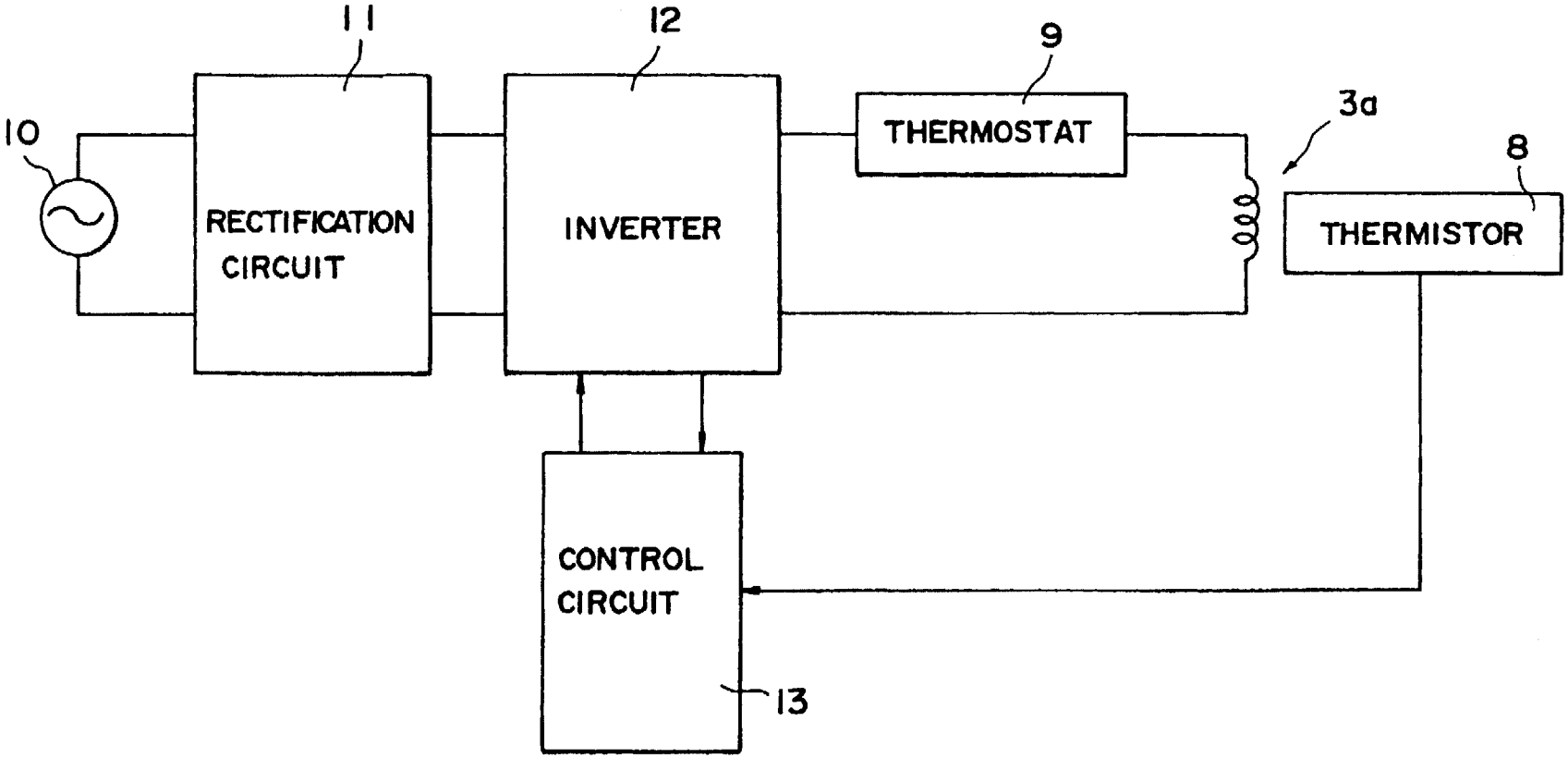
FIG. 6 is a block diagram showing a circuit for controlling the temperature of the fixing belt by applying a high frequency current to the coil.

FIG. 6 is a block diagram of the circuit controlling the temperature of the fixing belt 5 by applying a high frequency current to the coil 3*a*. An alternating current (AC) generated by a commercial power source 10 is rectified by a rectification circuit 11, the current then being converted to high frequency by an inverter 12 to generate a selected high frequency current. The current supplied to the induction heating coil 3*a* is supplied via a thermostat 9 which cuts off the current circuit when the fixing belt 5 attains a predetermined temperature. A control circuit 13 includes a microcomputer or the like, and controls the temperature by outputting ON/OFF signals to the inverter circuit 12 while monitoring the temperature of the fixing belt 5 by measuring the potential via a thermistor 8. The thermistor 8 and the thermostat 9 are respectively positioned on the interior side and the exterior side of the fixing belt 5 adjacent to the heating region.

Figure 7:
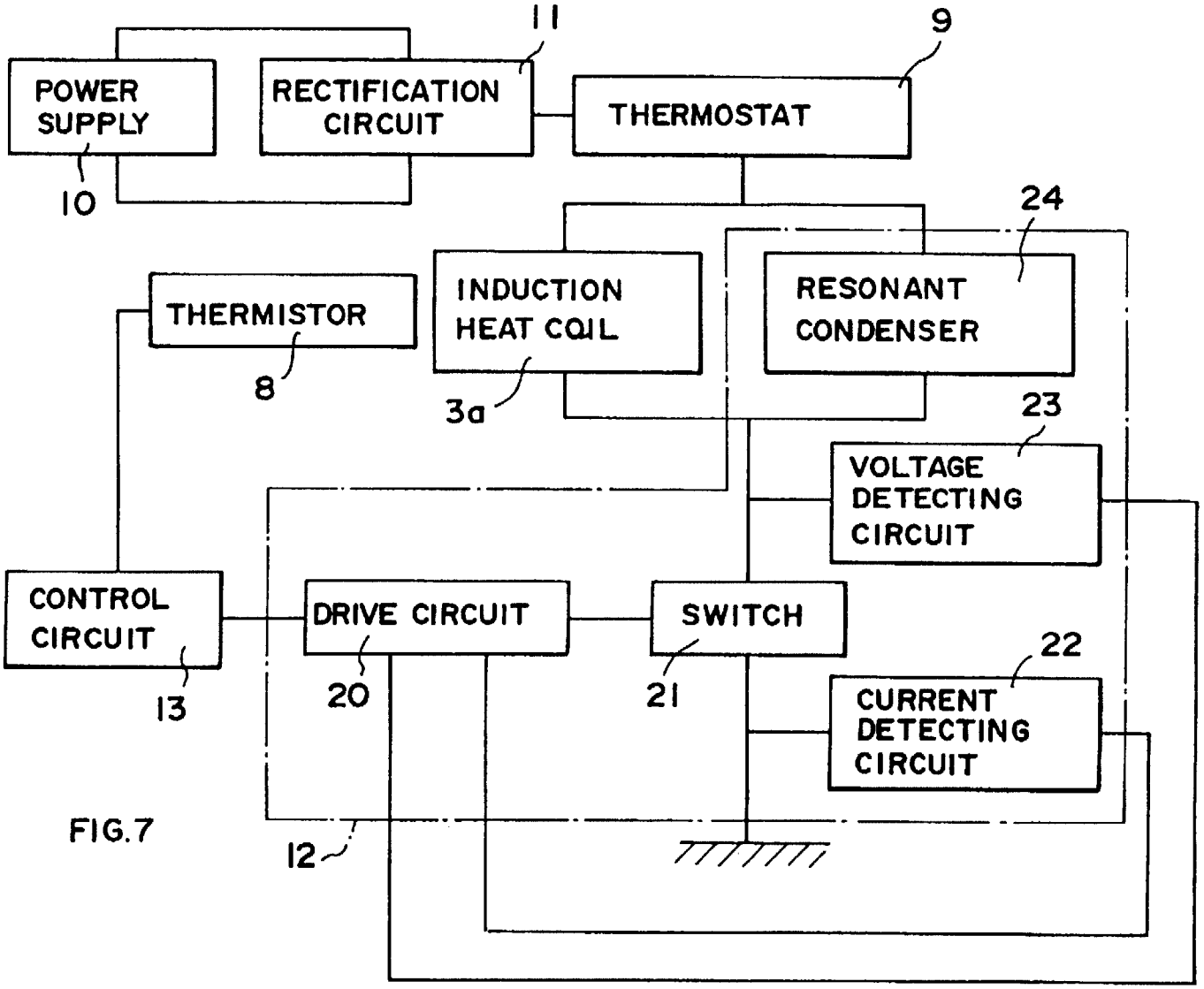
FIG. 7 is a block diagram of an inverter.
Figures 8A, 8B, 8C:
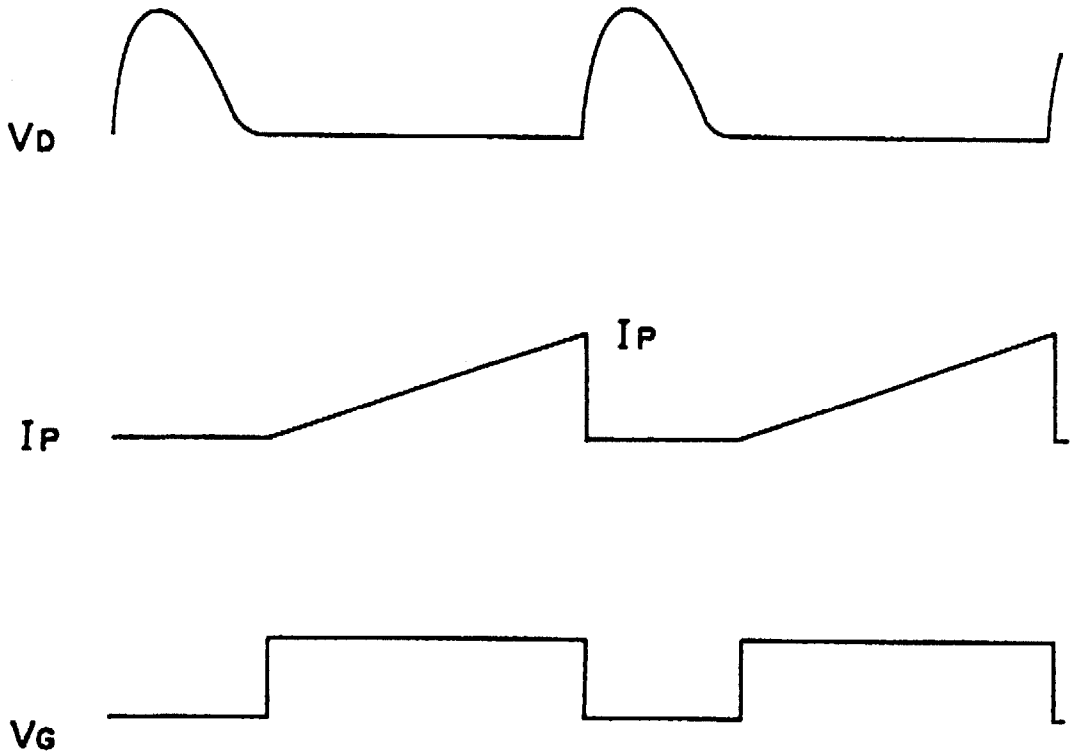
FIG. 8(A) is a waveform diagram showing the voltage detected by the voltage detecting circuit shown in FIG. 7.
FIG. 8(B) is a waveform diagram showing the current detected by the current detecting circuit shown in FIG. 7.
FIG. 8(C) is a waveform diagram showing the ON/OFF signal shown in FIG. 7.

FIG. 7 is a block diagram showing the operation of the inverter 12 shown in FIG. 6. According to the operation of inverter 12, when control circuit 13 outputs an ON signal (heating signal), a drive circuit 20 switches ON switch 21, and current flows to induction heating coil 3*a*. Switch 21 includes switching elements such as, for example, transistors, FET or IGBT or the like. On the other hand, when current detection switch 22 detects the attainment of a predetermined current value $I_p$ (with reference to FIG. 8(B)), a signal is transmitted to drive circuit 20 to turn OFF switch 21. The waveform of current $I_p$ detected by current detecting circuit 22 is shown in FIG. 8(B). When switch 21 is turned OFF, a resonant current flows between the induction heating coil 3*a* and a resonant condenser 24. When a voltage detecting circuit 23 detects that a voltage $V_D$ on the induction heating coil 3*a* side of switch 21 falls from resonance to the vicinity of 0 V, a signal is transmitted to drive circuit 20 to again turn ON switch 21. A high frequency current flows to induction heating coil 3*a* by repeating the aforesaid switching cycle. FIG. 8(A) shows the waveform of voltage $V_D$ detected by voltage detecting circuit 23, and FIG. 8(C) shows the ON/OFF signal (e.g., in the case of an FET, the gate ON/OFF signal) of switch 21.

The operation of the present embodiment is described below. Magnetic flux is generated perpendicular to the direction of movement of fixing belt 5 by means of a high frequency current flowing to the electromagnetic induction coil 3*a* of the coil assembly 15*a* arranged on the interior side of the fixing belt 5. As a result, an eddy-like induction current is generated in fixing belt 5, which is heated by natural resistance. A recording sheet P bearing a transferred toner image is heated by the heated fixing belt 5 by non-contact radiation heating and after toner in the heated area is softened to a certain extent, the recording sheet P is fed into the nip formed between the fixing belt 5 and the pressure roller 6. The toner image transferred onto the recording sheet P is suitably softened and fixed onto the recording sheet via the heat and pressure provided at the nip.

According to the present embodiment, coil assembly 15*a* is arranged on the interior side of the fixing belt 5 to heat the fixing belt 5 by generating an induction eddy current, such that space is effectively utilized and the device can be rendered in a compact form. Furthermore, because the fixing belt 5 shields against the noise generated by the electromagnetic induction coil 3*a*, a small shield member is sufficient and further increases the compactness of the fixing device, thereby achieving an important stated object of the present invention.

The coil assembly 15*a* is mounted at a position opposite the transported recording sheet P through fixing belt 5, such that the heating region can be set at the length of the recording sheet in the transport direction. Thus, the fixing temperature can be set lower, thereby achieving another important object of the present invention, i.e., conserving operating energy by operating at a reduced toner fixing temperature.

Since the fixing belt 5 is itself heated there is no heat transmission contact resistance between the fixing belt 5 and the toner on the recording sheet, thereby minimizing heat loss. Furthermore, the heat capacity of the heated region can be reduced, and the time until the heated region attains a set fixing temperature, i.e., standby time, is greatly reduced, thereby achieving yet another objective of the present invention.

Contact-induced noise is also alleviated because the recording sheet bearing the transferred toner image is heated by non-contact radiation provided by heated fixing belt 5.

Figure 9:
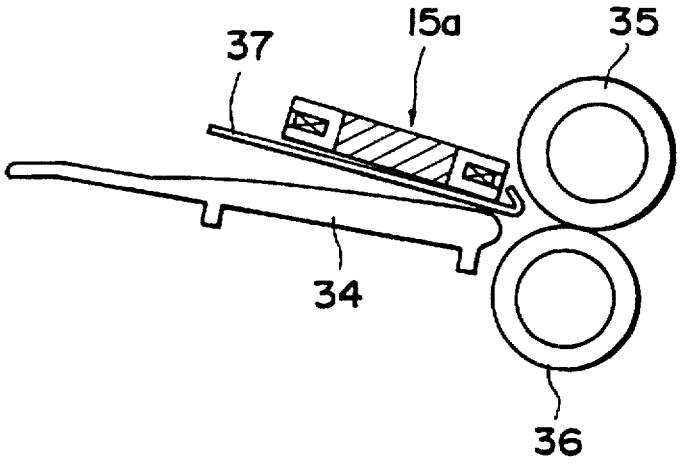
FIG. 9 is a side elevation view partly in cross-section, showing a second embodiment of the electromagnetic induction heating type fixing device of the present invention.

FIG. 9 is a side elevation view of the main portion of a second embodiment of the electromagnetic induction heating type fixing device of the present invention (generally designated by reference numeral 200). According to this embodiment, a top prefixing guide 37 is provided as a guide member comprising a conductive member. Also provided are a coil assembly 15*a* for generating an induction eddy current in the top prefixing guide 37, and a roller pair 35 and 36 for gripping and transporting the recording sheet P. As previously described, coil assembly 15*a* comprising coil 3*a* and core 2*a* held by bobbin 1*a* is mounted at a position opposite the transported recording sheet through top prefixing guide 37, and the aforesaid pair of rollers 35 and 36 are provided immediately downstream of top prefixing guide 37. The confronting surfaces of roller pair 35 and 36 are coated with a material having release characteristics relative to toner, e.g., fluororesin, silicone rubber or the like.

According to this embodiment, an induction current is generated in the top prefixing guide 37 by means of a high frequency current flowing to coil 3*a*, so as to heat the top prefixing guide 37. A recording sheet bearing a transferred toner image is transported to the opening defined by the prefixing guides 34, and 37 from the left side of FIG. 9, and is heated by heated top prefixing guide 37 by non-contact radiation heating. The toner in this region is softened to a certain extent, and a certain degree of heat accumulates on the toner and recording sheet, and then the recording sheet is transported into the nip formed by roller pair 35 and 36. The toner is fused onto the recording sheet by the heat that accumulated on the toner and recording sheet and the pressure provided at the nip by the cooperating pair of rollers 35 and 36.

Thus, if a top prefixing guide 37 is used which is formed of a conductive member rather than a fixing belt, the fixing device becomes extremely inexpensive, and the cost of the apparatus also is reduced.

Figure 10:
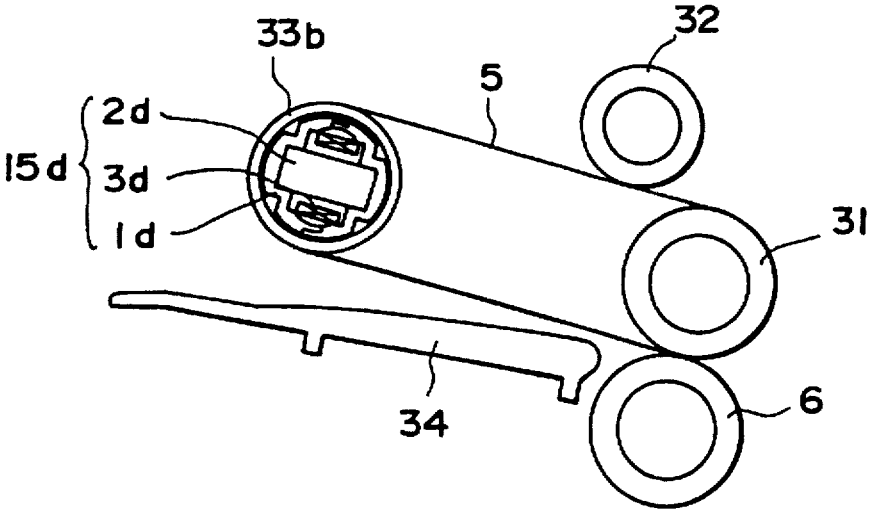
FIG. 10 is a side elevation view showing a third embodiment of the electromagnetic induction heating type fixing device of the present invention.

According to a third embodiment of the electromagnetic induction heating type fixing device, the main portion of which is shown in FIG. 10 (generally designated by reference numeral 300), a coil assembly 15*d* having a coil 3*d* and a core 2*d* held by bobbin 1*d*, is arranged on the interior side of tension roller 33*b*, and an induction current is generated in the fixing belt 5 by means of a high frequency current flowing to coil 3*d* to heat the fixing belt 5. Since the tension roller 33*b* is constructed of a selected material having a specific inductive capacity of less than 10, e.g., aluminum, copper, or alloys thereof, virtually all the magnetic flux generated by coil 3*d* passes through the tension roller 33*b* and reaches the fixing belt 5.

The heat of heated fixing belt 5 is partially retained by the fixing belt 5 and partially conducted through contact to tension roller 33*b*. Fixing belt 5 includes a web formed of carbon steel, stainless steel alloy, or nickel or the like, the surface of which is provided with a heat-release resistant type layer or heat-resistant rubber layer. Heat migration is slight in the widthwise direction of the fixing belt 5 because the combined thicknesses of the substrate at 10–60 μm, and the overcoat layer at 10–500 μm are extremely thin. According to the present embodiment, the thermal conductivity of tension roller 33*b* is 200 (W/m/K) or higher, such that the heat conducted through contact from the fixing belt 5 travels in the axial direction of tension roller 33*b* to achieve a uniform temperature distribution in the widthwise direction of fixing belt 5. Heat migration occurs at the rate of Q (quantity of heat transmitted per unit time)=$\lambda f\ (\theta 1-\theta 2)/L$ according to Fourier's law, where $\lambda$ is the thermal conductivity, f is sectional area, $\theta 1-\theta 2$ is the temperature differential, and L is length. Accordingly, the quantity of conducted heat Q is proportional to sectional area f, whereby heat migration from a point of the sectional area in the direction of heat migration in the widthwise direction of the relatively thin fixing belt 5 (i.e., in the axial direction of tension roller 33*b*) is less than the heat migration in the axial direction of tension roller 33*b* which is thicker than fixing belt 5.

The fixing belt 5 is held by drive roller 31 and tension roller 33*b*, and is transported by the rotation of drive roller 31. A recording sheet bearing a transferred toner image is transported in the manner described for the embodiment shown in FIG. 1, and is heated by moving fixing belt 5 by non-contact radiation heating so that the toner is completely fused onto the recording sheet via pressure and heat at the nip formed between pressure roller 6 and drive roller 31.

Thus, according to the present embodiment, uniform temperature distribution is achieved in the widthwise direction of the fixing belt 5, so as to realize excellent fixing of the toner on the recording sheet.

What is claimed is:

1. A fixing device for fixing on a recording member a toner image formed on the recording member, said device comprising:

a drive roller;

a tension roller;

a belt arranged in a loop about said drive roller and said tension roller such that said tension roller exerts a tension force on said belt;

a pressure roller positioned adjacent said drive roller such that said belt and said pressure roller form a nip therebetween as said belt is moved in a first direction about said drive roller and said tension roller;

a guide positioned exteriorly of said belt for guiding a recording member alongside but spaced from a portion of said belt when said belt is being moved in said first direction, wherein said portion of said belt is upstream of said nip and downstream of said tension roller when said belt is being moved in said first direction; and a heater, arranged on an interior side of said tension roller, for heating said belt as said belt passes in contact with said tension roller so that said portion of said belt heats the recording member by radiation from said belt softening said toner image on said recording member as the recording member moves along said guide toward said nip without said recording member contacting said portion of said belt;

wherein said pressure roller applies pressure to the thus heated recording member for fixing said toner image on the heated recording member as the thus heated recording member enters said nip and passes between said belt and said pressure roller.

2. The fixing device according to claim 1, wherein said heater comprises an electromagnetic induction coil.

3. A fixing device according to claim 1, wherein a length of said portion of said belt along said first direction is substantially equal to a length of the recording member.

4. A fixing device for fixing onto a recording member a toner image formed on the recording member, said device comprising:

a guide for guiding the recording member;

a heater for heating said guide so as to heat the recording member by radiation from said guide: and fixing means for fixing said toner image on the heated recording member.

5. A fixing device for fixing on a recording member a toner image formed on the recording member, said device comprising:

a first roller;

a second roller;

a fixing belt having a conductive element, said fixing belt being arranged in a loop about said first roller and said second roller;

a pressure roller positioned adjacent said second roller such that said belt and said pressure roller form a nip therebetween as said belt is moved in a first direction about said first and second rollers;

a guide positioned exteriorly of said fixing belt for guiding the recording member alongside but spaced from a portion of said fixing belt when said fixing belt is being moved in said first direction, wherein said portion of said fixing belt is upstream of said nip and downstream of said first roller when said belt is being moved in said first direction; and an electromagnetic induction heater, positioned on one side of said portion of said fixing belt and adjacent to said conductive element, for generating an induction eddy current in said conductive element for heating said portion of said fixing belt to, in turn, heat the recording member softening said toner image on the recording member as the recording member is guided by said guide toward said nip.

6. The fixing device according to claim 5, wherein said electromagnetic induction heater comprises a plurality of separate coils, each of said plurality of separate coils being controlled independently from each other.

7. The fixing device according to claim 5, further comprising a detecting device for detecting a temperature of said fixing belt, and a controller for controlling said electromagnetic induction heater based on the thus detected temperature.

8. A fixing device according to claim 5, wherein a length of said portion of said fixing belt along said first direction is substantially equal to a length of the recording member.

9. A fixing device for fixing onto a recording member a toner image formed on the recording member, said device comprising:

a first roller;

a second roller;

a fixing belt formed of a conductive member and being arranged in a loop about said first and second rollers;

a guide member positioned exteriorly of said belt for guiding the recording member alongside but spaced from a portion of said fixing belt when said fixing belt is being moved in a first direction, wherein said portion of said belt is upstream of said second roller and downstream of said first roller; and an electromagnetic induction heater positioned substantially within the interior of said loop for generating an induction eddy current in said conductive member for heating said portion of said fixing belt to, in turn, heat the recording member softening said toner image on the recording member as the recording member is guided by said guide member toward said second roller.

10. The fixing device according to claim 9, further comprising a pressure member for impressing the recording member against said fixing belt to fix the toner image onto the recording member after the recording member has been heated.

11. The fixing device according to claim 9, wherein said electromagnetic induction heater comprises a plurality of separate electromagnetic induction coils, each of said plurality of separate electromagnetic induction coils being controlled independently from each other.

12. The fixing device according to claim 9, further comprising a detecting device for detecting a temperature of said fixing belt, and a controller for controlling said electromagnetic induction heater based on the thus detected temperature.

13. A fixing device according to claim 9, wherein a length of said portion of said belt along said first direction is substantially equal to a length of the recording member.

14. A fixing device for fixing onto a recording member a toner image formed on the recording member, said device comprising:

a guide member formed of a conductive member for guiding the recording member;

an electromagnetic induction heater for generating an induction eddy current in said guide member; and a pair of rollers for gripping and transporting the recording member;

wherein said electromagnetic induction heater is positioned at a position opposite a recording member being guided by said guide member, and wherein said pair of rollers is positioned adjacent to said guide member on a downstream side thereof.

15. The fixing device according to claim 14, wherein said pair of rollers applies pressure to the recording member.

16. The fixing device according to claim 14, wherein said electromagnetic induction heater comprises a plurality of separate coils, each of said plurality of separate coils being controlled independently from each other.

17. The fixing device according to claim 14, further comprising a detecting device for detecting a temperature of said guide member, and a controller for controlling said electromagnetic induction heater based on the thus detected temperature.

18. A fixing device for fixing on a recording member a toner image formed on the recording member, said device comprising:

a drive roller;

a tension roller;

a fixing belt formed of a conductive member and arranged in a loop about said drive roller and said tension roller such that said tension roller exerts a tension force on said fixing belt;

a guide positioned exteriorly of said fixing belt for guiding the recording member alongside but spaced from a portion of said belt when said belt is being moved in said first direction, wherein said portion of said belt is upstream of said drive roller and downstream of said tension roller when said belt is being moved in said first direction; and an electromagnetic induction heater for generating an induction eddy current in said conductive member to heat said fixing belt to, in turn, heat the recording member, positioned adjacent to but spaced from a side of said fixing belt opposite said electromagnetic induction heater, by radiation from said fixing belt softening said toner image on said recording member as the recording member is being moved in said first direction;

wherein said electromagnetic induction heater is arranged on an inner side of said tension roller.

19. The fixing device according to claim 18, further comprising a pressure member for impressing the recording member against said fixing belt to fix the toner image onto the recording member after the recording member has been heated.

20. The fixing device according to claim 18, wherein said electromagnetic induction heater comprises a plurality of separate coils, each of said plurality of separate coils being controlled independently from each other.

21. The fixing device according to claim 19, further comprising a detecting device for detecting a temperature of said fixing belt, and a controller for controlling said electromagnetic induction heater based on the thus detected temperature.

22. A fixing device according to claim 18, wherein a length of said portion of said belt along said first direction is substantially equal to a length of the recording member.

23. A device for imparting heat to a recording member on which a toner image is to be fixed comprising:

a first roller;

a second roller;

a fixing belt having a conductive element and being arranged in a loop about said first and second rollers;

a guide positioned exteriorly of said fixing belt for guiding the recording member alongside but spaced from a portion of said belt when said belt is being moved in a first direction, wherein said portion of said belt is upstream of said first roller and downstream of said second roller when said belt is being moved in said first direction; and an electromagnetic induction heater for generating an induction eddy current in the conductive element of said fixing belt to heat said fixing belt to, in turn, heat the recording member which is adjacent to but spaced from said portion of said belt such that the recording member is heated by radiation without contacting said portion of said fixing belt softening said toner image on said recording member;

wherein said electromagnetic induction heater is arranged on an inner side of said second roller.

24. A method of fixing on a recording member a toner image formed on the recording member, said method comprising the steps of:

providing a fixing belt having a conductive element;

generating an induction eddy current in the conductive element to heat said fixing belt;

positioning the recording member adjacent to and spaced from a portion of said fixing belt to heat the recording member by radiation from a heated portion of said fixing belt softening said toner image on said recording member; and then applying pressure to the thus heated recording member to fix the toner image on the thus heated recording member without the recording member contacting said fixing belt prior to the application of pressure to the thus heated recording member.

25. The method of fixing a toner image as claimed in claim 24, comprising the additional step of forming said fixing belt into a substantially closed loop;

wherein said generating step comprises the step of positioning an electromagnetic induction heater substantially within said loop, and wherein said recording member is positioned outside of said loop.

26. The method of fixing a toner image as claimed in claim 25, comprising the additional steps of providing said electromagnetic induction heater as a plurality of separately operable induction coils; and individually adjusting an eddy current generated by each respective one of said plurality of separately operable induction coils.

27. The method of fixing a toner image as claimed in claim 24, comprising the additional step of adjusting said eddy current to generate a desired fixing temperature.

* * * * *